United States Patent [19]

Waters et al.

[11] Patent Number: 5,014,768

[45] Date of Patent: May 14, 1991

[54] CHILL PLATE HAVING HIGH HEAT CONDUCTIVITY AND WEAR RESISTANCE

[75] Inventors: William J. Waters, Cleveland; George W. Leissler, Fairview Park; Brian J. Edmonds, Cleveland, all of Ohio

[73] Assignee: Waters & Associates, Cleveland, Ohio

[21] Appl. No.: 373,495

[22] Filed: Jun. 30, 1989

[51] Int. Cl.[5] ..... B22D 11/00; B22C 1/00

[52] U.S. Cl. ..... 164/418; 164/138

[58] Field of Search ..... 164/418, 138

[56] References Cited

U.S. PATENT DOCUMENTS

| | | | |
|---|---|---|---|
| 3,322,515 | 5/1967 | Dittrich et al. | 149/5 |
| 3,892,644 | 7/1975 | Borg et al. | 204/164 |
| 4,197,902 | 4/1980 | von Jan et al. | 164/418 |
| 4,579,165 | 4/1986 | Kamei et al. | 164/418 |
| 4,668,298 | 5/1987 | Funahashi | 106/287.13 |
| 4,693,296 | 9/1987 | King | 164/440 |
| 4,787,228 | 11/1988 | Weisner et al. | 164/418 |

FOREIGN PATENT DOCUMENTS

| | | | |
|---|---|---|---|
| 2701636 | 7/1978 | Fed. Rep. of Germany | 164/418 |
| 54-001237 | 1/1979 | Japan | 164/418 |
| 54-004236 | 1/1979 | Japan | 164/418 |
| 54-004237 | 1/1979 | Japan | 164/418 |
| 54-071724 | 6/1979 | Japan | 164/418 |
| 61-083680 | 4/1986 | Japan | 164/418 |
| 715209 | 2/1980 | U.S.S.R. | 164/418 |

*Primary Examiner*—Richard K. Seidel
*Assistant Examiner*—Rex E. Pelto
*Attorney, Agent, or Firm*—Tarolli, Sundheim & Covell

[57] ABSTRACT

A chill plate for continuous casting of high melting temperature metals. The chill plate is made from a copper substrate and subsequently coated by plasma spraying. The copper mold coating composition consists of a copper alloy, 10 to 20% by volume refractory powder having a mean particle size between about 5 to 250 microns, and 3 to 7% by volume of a flammable metal powder.

12 Claims, No Drawings

CHILL PLATE HAVING HIGH HEAT CONDUCTIVITY AND WEAR RESISTANCE

BACKGROUND OF THE INVENTION

1. Technical Field

The present invention relates to a composite article having improved heat conductivity and wear resistance, and more particularly to an improved heat conductive and wear resistant chill plate for continuous casting of metals. The present invention will be particularly described with respect to continuous casting of ferrous metals, such as iron and steel.

2. Description of the Prior Art

U.S. Pat. No. 4,197,902 discloses electrolytic deposition of a layer of nickel combined with alumina or silicon carbide filler particles onto a copper or copper alloy mold, for use in continuous casting. The layer is said to provide wear resistance and thermal shock resistance and to adhere well to the copper base. It is indicated in the patent that application of a coating by flame spraying or plasma spraying can not be used for making a continuous casting mold because coatings applied by flame or plasma spraying tend to be porous and thus relatively corrosion prone. Also, it is indicated in the patent that coatings applied by flame or plasma spraying have relatively low adherence and shock resistance. It is also indicated that such coatings have a non-uniform thickness which requires subsequent machining of the coatings making flame or plasma spraying uneconomical. A plasma sprayed molybdenum coating was mentioned as an example.

U.S. Pat. No. 4,693,296 discloses the construction of a break ring in a continuous caster by first plasma spraying boron nitride, silicon nitride, or aluminum nitride into a mold. A second layer of zirconium oxide, aluminum oxide, or silicon carbide is then applied by plasma spraying, followed by plasma spraying a third layer of copper or aluminum oxide. The mold is shaped so that the first layer of boron nitride, silicon nitride, or aluminum nitride constitutes the wear surface of the break ring.

Prior U.S. Pat. No. 3,892,644 discloses a cermet powder which comprises a homogeneous blend of a refractory material and a matrix material. A suitable matrix material is said to be copper. Suitable refractory materials listed include silicon carbide and tungsten carbide. One example of a cermet powder given in the patent is a blend of boron carbide and copper. The patent is directed primarily to the process by which the homogeneous blend is made. It is suggested in the patent that the cermet particles are useful for cutting tools and wear parts.

SUMMARY OF THE INVENTION

The present invention resides in the discovery of a new and improved heat conductive and wear resistant composite article particularly useful as a chill plate for continuous casting of metals. The composite article comprises a copper substrate and a wear resistant coating. The coating is formed by plasma spraying onto the copper substrate a coating composition comprising a copper powder and at least one refractory powder. A preferred refractory powder is silicon carbide having a mean particle size distribution of −62+37 microns. The amount of refractory powder is about 10%-20% based on the volume of the copper powder. The coating composition also contains about 3%-7%, based on the volume of copper powder, of a flammable metal. The flammable metal ignites during the plasma spraying in an exothermic reaction which provides in-situ generation of heat. A preferred flammable metal is aluminum. The substrate is preheated to about 150° F. to about 250° F. prior to plasma spraying.

DESCRIPTION OF A PREFERRED EMBODIMENT

Chill plates for continuous casting high melting temperature metals such as iron or steel are cooling plates that are inserted within the original solidification zone of the continuous casting apparatus. To function properly, the chill plates must be made of a material having high thermal conductivity. The chill plates must also have good wear resistance, as well as a thickness sufficient to meet expected mechanical wear. In the present invention, the chill plates comprise a substrate of copper which has a wear resistant coating applied to the surface of the copper. The copper substrate can be pure copper or a copper alloy. The thickness of the copper substrate is not critical. The process of the present invention can be practiced with copper substrates having a thickness of up to about two inches. To assure physical integrity, the thickness of the substrate is preferably at least about one inch.

The wear resistant coating of the present invention comprises a matrix of copper and one or more refractory materials. The coating is formed by plasma spraying a coating composition containing copper powder and one or more refractory powders. The copper powder can be pure copper powder or a copper alloy powder. The present invention was successfully practiced with copper powder which was 99% pure. The particle size of the copper powder is dictated more by the constraints of the plasma spray apparatus than the plasma spray process or requirements of the chill plate. Too fine a copper powder cannot be successfully gravity fed using a standard gravity feed hopper. Preferably the copper powder has a mean particle size distribution of −106+44 microns.

The refractory material should have sufficient hardness and wear resistance to withstand abrasion in a continuous casting apparatus. The refractory material should also have a sufficiently high melting point that it remains as discrete particles during the plasma spraying process. A preferred refractory material is silicon carbide having a mean particle size distribution of −62+37 microns.

Other refractory materials that can be employed include other carbides such a boron carbide, titanium carbide, hafnium carbide, molybdenum carbide, zirconium carbide, columbium carbide, tungsten carbide, magnesium carbide, aluminum carbide, and alloys thereof; oxides such as aluminum oxide, titanium dioxide, silicon dioxide, zirconium oxide, chromium oxide, magnesium oxide, and mixtures or alloys thereof; mixtures or alloys of carbides and oxides; and nitrides such as titanium nitride, boron nitride, hafnium nitride, silicon nitride, tantalum nitride, zirconium nitride, aluminum nitride, and mixtures thereof.

The particle size of the refractory material used is important. The refractory particles should be sufficiently small that they are retained in the copper matrix which is formed during the plasma spray process. Particles which are too large may be deflected from the substrate surface being coated and not retained in the copper matrix. The particular particle size used depends upon the refractory material selected. Broadly, the refractory material should have a mean particle size distribution of −250+5 microns, preferably −150+5 microns.

The amount of refractory material used is also important. It should be sufficient to provide wear and abrasion resistance. Thus, at least 10% refractory particles, based on the volume of the copper powder, is required. Too much refractory material reduces the heat conductivity of the coating. Up to 20% refractory particles, based on the volume of the copper powder, can be used without significant loss of functionality of the coating with regards to heat conductivity.

The coating composition of the present invention also contains about 3% to about 7% of a flammable metal. A preferred flammable metal is aluminum. Other flammable metals such as magnesium can be used. The flammable metal ignites, as indicated above, during plasma spraying providing an in-situ generation of heat which substantially enhances the tensile strength of the bond between the formed copper matrix of the coating and the copper substrate to which the coating is applied.

The substrate surface to which the wear resistant coating is applied should be well cleaned prior to plasma spraying, using known cleaning procedures. Conventional cleaning procedures can be used. In the process of the present invention, the surface was cleaned with a sand blasting apparatus using a relatively coarse alumina grit to remove surface oxidation.

Preferably, the substrate is preheated immediately prior to plasma spraying. If the plasma spraying is carried out using standard apparatus, without a protective atmosphere, the substrate should not be preheated to substantially more than about 200° F. to avoid surface oxidation of the substrate.

The plasma spraying can be done using known procedures and commercially available equipment. The spraying can be carried out under ambient conditions, using argon as the primary and carrying gas, or can be carried out under vacuum. An advantage of the latter procedure is that it permits preheating to higher temperatures without oxidation of the substrate, for instance, up to about 1400° F. Preferably the plasma spraying is carried out using a robot. The coating of the present invention is formed by applying a plurality of successive layers onto the substrate. Each layer may have a thickness of about one to two mils. The coating can be built up to many layers, for instance up to twenty layers, providing a coating thickness up to about 0.030 inches without the loss of tensile strength in the bond between the coating and the chill plate substrate. Using a robot, close tolerances can be maintained. For instance, final coatings having a thickness of ±2 mils can be obtained.

The coatings of the present invention provide excellent wear resistant and heat conductive surfaces suitable for continuous casting of high melting point metals such as iron and steel. They are formed with very low porosity, less than about 2% porosity, minimizing corrosion. The coatings form an excellent bond to the copper substrate. As the chill plates of the present invention comprise a predominantly copper coating applied onto a copper substrate, wherein the coating has essentially the same coefficient of expansion as the substrate, flaking of the coating from the substrate, due to shear stresses during continuous casting, is less likely to occur.

The present invention will be discussed in additional detail in the following Example. In this Example, all parts, percentages and ratios are by volume unless otherwise indicated.

EXAMPLE

In this Example, the powder to be plasma sprayed has the following composition:

| Ingredient | Mean Particle Size Distribution |
|---|---|
| Copper | −106 + 44 microns |
| Silicon carbide | −62 + 37 microns |
| Aluminum | −90 + 44 microns |

The amount of silicon carbide employed is 10% based on the volume of copper. The amount of aluminum is 5% based on the volume of copper. The powders are blended together in a mechanical V-blender for fifteen minutes.

The substrate is a copper sheet having a thickness of about one inch. The copper sheet is cleaned by using a No. 60 high purity alumina grit containing about 4% $TiO_2$ hardener in a conventional sand blasting machine. The cleaning process removes oxides and roughens the substrate surface. The copper sheet is then preheated to about 200° F.

The blend of powders is placed in the hopper of a Metco plasma spray torch Model 3MB. The spray torch is operated under the following conditions:

Primary Gas: Argon at 28 standard liters per minute
Secondary Gas: Helium at 7 standard liters per minute
Carrying Gas: Argon at 3 standard liters per minute
Hopper speed: 1.1 RPM
Arc power setting: 20 KW
Distance torch to part: 7.6 centimeters The coating is laid down in a series of successive passes, each pass depositing a layer having a thickness of about 1–2 mils. The layers are applied with a robot at a linear speed of about 300 millimeters per second. Eighteen passes are made to build up on the substrate a coating having a thickness of about 0.030 inch.

The coating adheres well to the substrate. The substrate is capable of bending around a two inch diameter mandrel without fracture of the bond between the coating and substrate. The coating, as viewed under an electron microscope is non-porous. The coating gives excellent resistance to temperature shock. The composite structure is considered to be useful as a chill plate for continuous casting of ferrous metals such as iron or steel.

From the above description of a preferred embodiment of the invention, those skilled in the art will perceive improvements, changes and modification. Such improvements, changes and modifications within the skill of the art are intended to be covered by the appended claims.

Having described a preferred embodiment of the present invention, the following is claimed:

1. A chill plate for continuous casting of high melting temperature metals comprising:

a copper substrate;

a coating applied to said substrate by plasma spray application of a coating composition, said coating composition comprising:

(i) copper powder having a mean particle size between about 44 microns and above 160 microns;

(ii) about 10% to about 20%, based on the volume of copper powder, of silicon carbide having a mean particle size between about 37 microns and about 62 microns; and (iii) about 3% to about 7%, based on the volume of copper powder, of aluminum having a mean particle size between about 44 microns and about 90 microns.

2. The chill plate of claim 1 wherein said coating has a thickness up to about 0.030 inches.

3. The chill plate of claim 2 wherein said substrate has a thickness of about 0.5 to about two inches.

4. The chill plate of claim 3 for continuous casting of ferrous metals.

5. A chill plate for continuous casing of high melting temperature metals comprising:

a copper substrate;

a coating applied to said substrate by plasma spray application of a coating composition, said coating composition comprising:

(i) copper or copper alloy powder;

(ii) about 10% to about 20%, based on the volume of copper or copper alloy powder, of a refractory powder having a mean particle size between about 5 microns and about 250 microns; and (iii) about 3% to about 7%, based on the volume of copper or copper alloy powder, of a flammable metal powder.

6. The chill plate of claim 5 wherein said flammable metal power is selected from the group consisting of aluminum and magnesium.

7. The chill plate of claim 5 wherein said refractory powder is silicon carbide and said flammable metal powder is aluminum having a mean particle size between about 44 microns and about 90 microns.

8. The chill plate of claim 5 wherein said copper or copper alloy powder has a mean particle size between about 44 and about 160 microns.

9. The chill plate of claim 5 wherein said refractory powder has a mean particle size between about 5 microns and about 150 microns.

10. The chill plate of claim 5 wherein said coating has a porosity less than about 2%.

11. The chill plate of claim 5 wherein said coating is bonded to said substrate.

12. The chill plate of claim 11 wherein said coating has essentially the same coefficient of expansion as said substrate.

* * * * *